United States Patent [19]

Andrew et al.

[11] 4,278,342

[45] Jul. 14, 1981

[54] XEROGRAPHIC CHARGING

[75] Inventors: Jerry C. Andrew; Roberta R. Tanner, both of Longmont, Colo.

[73] Assignee: International Business Machines Corporation, Armonk, N.Y.

[21] Appl. No.: 72,384

[22] Filed: Sep. 4, 1979

[51] Int. Cl.[3] ..... G03G 15/00

[52] U.S. Cl. ..... 355/3 CH; 250/325; 355/3 R; 361/229

[58] Field of Search ..... 355/3 R, 3 CH, 14 R, 355/14 CH; 250/324, 325, 326; 361/229, 230, 235

[56] References Cited

U.S. PATENT DOCUMENTS

| | | | |
|---|---|---|---|
| 2,832,977 | 5/1958 | Walkup et al. | 15/1.5 |
| 3,610,749 | 10/1971 | Madrid | 355/17 |
| 3,647,293 | 3/1972 | Queener | 355/15 |
| 3,700,328 | 10/1972 | Davidge et al. | 355/3 R X |
| 3,728,016 | 4/1973 | Harbour et al. | 355/15 |
| 3,834,804 | 9/1974 | Bhagat et al. | 355/3 R |
| 3,982,830 | 9/1976 | Daniels et al. | 355/3 DD |
| 4,133,610 | 1/1979 | Bernardelli et al. | 355/3 CH |

*Primary Examiner*—Fred L. Braun

*Attorney, Agent, or Firm*—Francis A. Sirr

[57] ABSTRACT

A xerographic device having a reusable photoconductor which is subjected in repeating cycles to (1) a charge corona whereat the photoconductor is uniformly charged to a negative voltage, (2) an imaging station whereat a working portion of the photoconductor is selectively discharged, to leave a charged area on this working portion defining a negative electrostatic latent image to be reproduced on copy paper, (3) a magnetic brush developing station whereat negatively charged carrier beads transport positively charged toner to the photoconductor's latent image, to leave a toned image on the photoconductor, (4) a transfer station, including a negative transfer corona, whereat a portion of the photoconductor's toned image is transferred to copy paper, (5) a positive preclean corona whereat the negatively charged photoconductor and its positive residual toner are subjected to a positive charge, and (6) a cleaning station whereat the photoconductor is cleaned by a brush having an affinity for positively charged particles. The charge corona spans a greater width of the photoconductor than does the developing station. The charge corona and the transfer corona span a lesser width of the photoconductor than the preclean corona.

7 Claims, 3 Drawing Figures

XEROGRAPHIC CHARGING

DESCRIPTION

BACKGROUND OF THE INVENTION

The present invention relates to xerographic devices.

In xerographic devices the steps of charging, imaging, developing, transferring and cleaning are well known and are practiced by a variety of means. For example, corona charging, followed by image-reflection discharging, followed by magnetic brush developing, followed by corona transfer, followed by preclean corona charging, and then brush cleaning have been practiced.

By way of example, it is conventional to charge a drum-shaped photoconductor negative, and to thereafter substantially discharge a working portion of the charged photoconductor in all white background areas, to leave a negative latent electrostatic image to be reproduced as a black image on a copy paper. An area of the photoconductor larger than, but including, this working area is then subjected to magnetic brush development. During development, negatively charged and magnetically permeable carrier beads are magnetically transported to a development zone which includes the photoconductor's working area and a nonworking area which borders or surrounds this working area.

The carrier beads are intended to be held within the developer by its magnetic field pattern and by seals which extend between the developer and the photoconductor.

The carrier beads carry small positively-charged toner particles to the photoconductor. As the photoconductor leaves this development zone, the photoconductor's negative latent image is heavily covered with black, positively charged toner, and the remainder of the photoconductor may carry a much smaller amount of randomly distributed toner particles.

Later, the photoconductor, including its now-toned latent image, passes through a transfer zone whereat a piece of white copy paper is placed on the photoconductor, coincident with its working area. The side of this copy paper opposite the photoconductor is subjected to the influence of a negative transfer corona. The paper's negative charge causes a toner image to be formed on the paper, leaving a residual toner image on the photoconductor.

Conventionally, the negative transfer corona spans a width which is greater than the paper, and therefore directly subjects border portions of the photoconductor, and toner particles which may reside thereon, to a negative charge.

The photoconductor, its residual toner image, and its randomly distributed toner particles are now subjected to the influence of a preclean positive corona. This corona tends to neutralize the photoconductor's negative charge, and tends to insure that all particles carried by the photoconductor, including toner, are charged positive. Such particles are charged positive for the purpose of obtaining proper cleaning action by the next xerographic station, namely, the cleaning station. At the cleaning station, the photoconductor is brushed to ideally remove all particles, including toner, from the photoconductor. Conventionally, the cleaning station is constructed and arranged to have an affinity for positively charged particles. It is not unusual, as a part of the cleaning process, to flood the photoconductor with light, to produce the effect of additionally neutralizing any charge carried by the photoconductor.

The prior art, for example U.S. Pat. No. 2,832,977, recognizes the advantage of providing a preclean corona. As a specific improvement, U.S. Pat. No. 4,133,610 provides a specified corona current to aid in the removal of tetrafluoroethylene carrier-coating particles from the photoconductor.

In the well known xerographic device, the above-described process is repeated, once for each copy.

Conventially, xerographic process stations such as the various charging stations and the developer are centered on the photoconductor, and their positions are accurately controlled, both as to centering and as to spacing from the photoconductor. If these parameters are not accurately controlled, problems such as toner filming and bead carryout can occur.

By way of definition, toner filming is that propensity of the toner to gradually coat the photoconductor over a period of many copy cycles so as to produce streaks in the resulting copies. Toner filming usually begins at the outside edges of the photoconductor and "grows" toward its center.

Bead carryout is that propensity of the developer's carrier beads to be carried out of the developer as the photoconductor passes through the development zone.

The prior art suggests solutions to the bead carryout problem. U.S. Pat. No. 3,834,804 provides a magnet which cleans the photoconductor of carrier beads which have been carried out of the developer; whereas, U.S. Pat. No. 3,982,830 alters a developer's development electrode bias voltage as a drum photoconductor's drum seal moves through the developer, to thereby reduce the number of carrier beads which may be carried out of the developer by the drum seal.

SUMMARY OF THE INVENTION

The present invention both reduces carrier bead carryout, on the photoconductor, and inhibits toner filming of the photoconductor which can occur as a result of less-than-optimum operation of the cleaning station.

While acknowledging that the problems of bead carryout and toner filming have been addressed by accurate positioning of the various xerographic process stations relative to the moving photoconductor, we have discovered that an additional way to solve these problems is by a charging source construction and arrangement whereby (1) the photoconductor charging source spans a width of the photoconductor greater than the width spanned by the developing source, to reduce bead carryout, and (2) the photoconductor charging source spans a width of the photoconductor less than the width spanned by the preclean charging source, but the preclean charging source spans a width of the photoconductor greater than the transfer charging source, to reduce toner filming.

More specifically, the construction and arrangement of the present invention provides a photoconductor charge source which spans a width of the photoconductor greater than the photoconductor width spanned by the developing station. The effect of this unique construction is to insure that the charged carrier beads are subjected to an electrostatic force tending to hold the beads in the developing station. By way of example, our invention insures that the photoconductor adjacent the side boundaries of the developing station will carry a negative charge. This negative charge operates to repel negatively charged carrier beads, thus reducing bead carryout.

If the developer is of the magnetic brush type, such an electrostatic force aids the developer's magnetic field in holding the carrier beads in the developer.

In addition, the construction and arrangement of our invention provides a photoconductor charge corona which spans a width of the photoconductor which is less than the photoconductor width spanned by the opposite-polarity preclean charge corona. The effect of this unique construction is to ensure that all toner which encounters the cleaning station has been subjected to a neutralizing opposite-polarity charge. By way of example, consider an arrangement wherein the photoconductor is charged negatively. Also, assume that a very small amount of toner remains on the photoconductor after cleaning, and enters this negative photoconductor charge source. This toner will in all likelihood proceed into the developer carrying a negative charge. It is unlikely that such a toner particle will be removed from the photoconductor by either the developing station or the transfer station. However, by the present invention's construction and arrangement which ensures that a positive preclean charge source spans a width of the photoconductor which is greater than the width spanned by the photoconductor charge source, such negative toner particles are restored to a positive polarity, or at least neutralized, to greatly increase the likelihood of removal as the photoconductor subsequently passes through the cleaning station. This effect is particularly important at the boundary portions of the photoconductor's width whereat it has been noted that toner filming starts, and subsequently "grows" toward the center of the photoconductor.

Also, in accordance with the present invention, a transfer charge source, if one is provided, is of a width less than that of the preclean charge source. The effect of this unique construction is also to prevent toner filming as can occur when the cleaning station attempts to clean the above-described residual toner particles from the photoconductor, which toner particles have been subjected to the transfer charge source, without having been subject to the opposite-polarity preclean charge source.

By this critical charge source length parameter, both carrier bead carryout and toner filming are substantially reduced (i.e. the photoconductor charge source is wider than the developer, but is not as wide as the preclean charge source; and the preclean charge source is wider than the transfer charge source).

The foregoing and other features of this invention, as well as its advantages and applications, will be apparent from the following detailed description of the preferred embodiments which are illustrated in the accompanying drawing.

DESCRIPTION OF THE PREFERRED EMBODIMENTS

Figure 1:
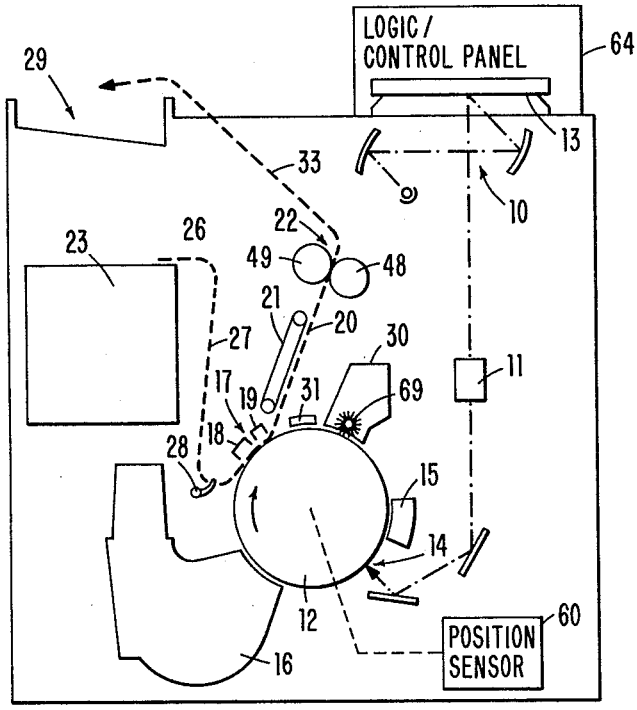
FIG. 1 is a schematic view of a xerographic copying device incorporating the present invention.

FIG. 1 is a schematic view of a xerographic copying device incorporating the present invention. In this copier a scanning mirror illumination system 10 and a moving lens 11 move in synchronism with the clockwise, constant speed rotation of photoconductor drum 12 to place the latent image of an original document 13 onto the working portion of the drum's photoconductor surface. As is well known, prior to imaging at 14 the drum is charged by corona 15, i.e. a photoconductor charging source. After imaging, the drum's latent image is toned or developed by developer 16, for example a magnetic brush developer. Thereafter the drum's toned visible image is transferred to a sheet of copy paper at transfer station 17 by operation of transfer corona 18, i.e. a transfer charging source. Sheet detach means 19 operates to cause the leading edge of the now-toned sheet to leave the surface of the drum and to follow sheet path 20, adjacent vacuum conveyor 21 on its way to hot roll fuser assembly 22. After fusing, the finished copy sheet follows sheet path 33 and is deposited in exit tray 29. After transfer, the drum is cleaned as it passes cleaning station 30. Cleaning station includes a preclean charging source in the form of corona 31. This corona charges particles which may be carried by the photoconductor to a polarity for which cleaning station's brush 69 has an electrostatic affinity.

The apparatus of FIG. 1 includes a copy sheet supply bin 23. This supply bin includes a bidirectionally movable elevator which supports the bottom sheet of the stack. A sheet feeder within the bin is operable to feed the top sheet of the stack to sheet discharge path 26. This sheet then travels down sheet path 27 to be momentarily stopped at alignment gate 28. When the leading edge of the drum's working area arrives at the vicinity of the gate, the gate is opened to allow the sheet to progress into transfer station 17 in exact registry with the working area.

The construction of the hot roll fuser is well known in the art. Generally, hot roll 48 is heated to an accurately controlled temperature by an internal heater and an associated temperature control system, not shown. The hot roll preferably includes a deformable external surface formed as a thin elastomeric layer. This surface is designed to engage the toned side of the copy sheet, fuse the toner thereon, and readily release the sheet with a minimum adherence of residual toner to the hot roll.

The nip formed by rolls 48 and 49 is preferably opened and closed in synchronism with the arrival and departure of the leading and trailing edges, respectively, of a copy sheet. This synchronism is achieved by a drum position sensing means 60 which responds to the position of drum 12 and effects opening and closing of the nip by means of a control system, not shown.

Figure 2:
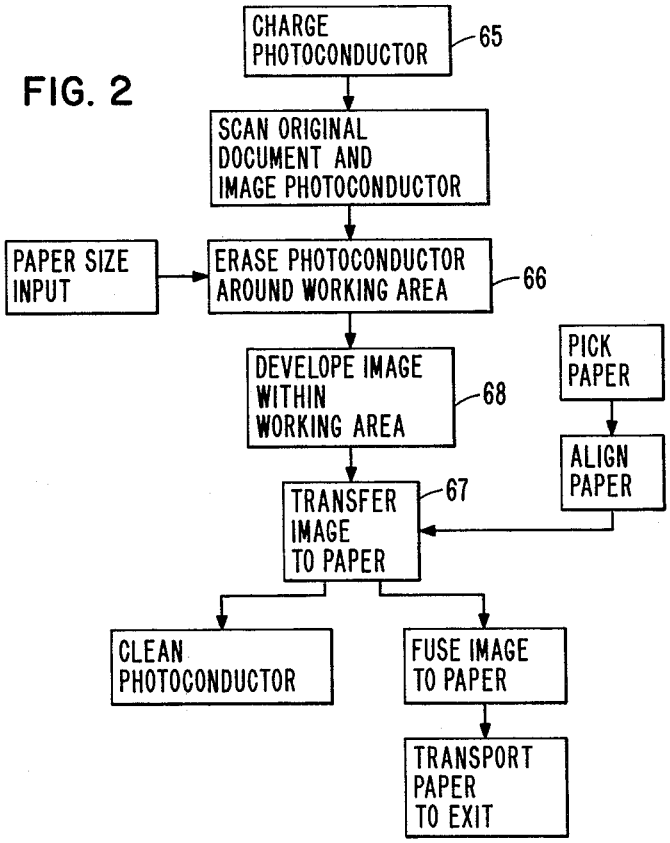
FIG. 2 is a flow-type representation of the xerographic process steps achieved by FIG. 1's copier logic/control panel.

The copying apparatus of FIG. 1 is controlled by logic/control panel 64 in a manner well known to those of skill in the art. This control is depicted in FIG. 2, and is typical of the execution of a single-copy request. The first event to occur is that of charging the photoconductor, as at 65. Thereafter, the original document is scanned and a latent electrostatic image thereof is formed on the photoconductor. By definition, that area of the photoconductor which will correspond to a sheet of paper at the transfer station is the photoconductor's working area. Due to the electrostatic mechanism by which the developing process operates, it is desirable that the photoconductor be discharged, i.e. erased, in the area around or bordering this working area. Thus, the next process step is that of erasing as at 66.

At or about this same time, a sheet of paper is picked from bin 23. While the photoconductor's image is developed, as at 68, the sheet of paper is aligned at gate 28 in preparation for transfer.

Thereafter, the photoconductor's toned image and the sheet of paper move through transfer station 17 to transfer toner to the paper, as at 67.

For purposes of example only, FIG. 1's photoconductor charge source 15 operates to charge photoconductor drum 12 to a negative 850 volts; imaging station 14 operates to produce a copy-white area of a negative 150 volts and a copy-black area of a negative 850 volts; developer 16 operates with a development electrode voltage of a negative 360 volts; transfer charging source 18 operates to produce a voltage of a negative 1200 volts on the side of a sheet of paper opposite the photoconductor; and preclean charging source 31 operates to produce a voltage of a positive 50 volts on an image-white portion of the photoconductor.

With such an exemplary arrangement, developer 16 contains negatively charged, magnetically permeable carrier beads, and positively charged toner particles coating these beads.

As used herein, the term "coronas" shall be considered generic to various forms of charging sources, such as for example scorotrons.

As presently described, the construction and arrangement of FIGS. 1 and 2 is well known to those of skill in the art, and serves the purpose of indicating the background of the invention and illustrating the state of the art.

The present invention is incorporated in the critical charging source length relationship that exists between FIG. 1's photoconductor charging source 15, developer station 16, transfer charging source 18 and preclean charging source 31. As the term is used herein, "length" will mean that dimension normal to the plane of FIG. 1. Also, when referring to the width of the photoconductor carried by drum 12, this dimension shall also be normal to the plane of FIG. 1.

Figure 3:
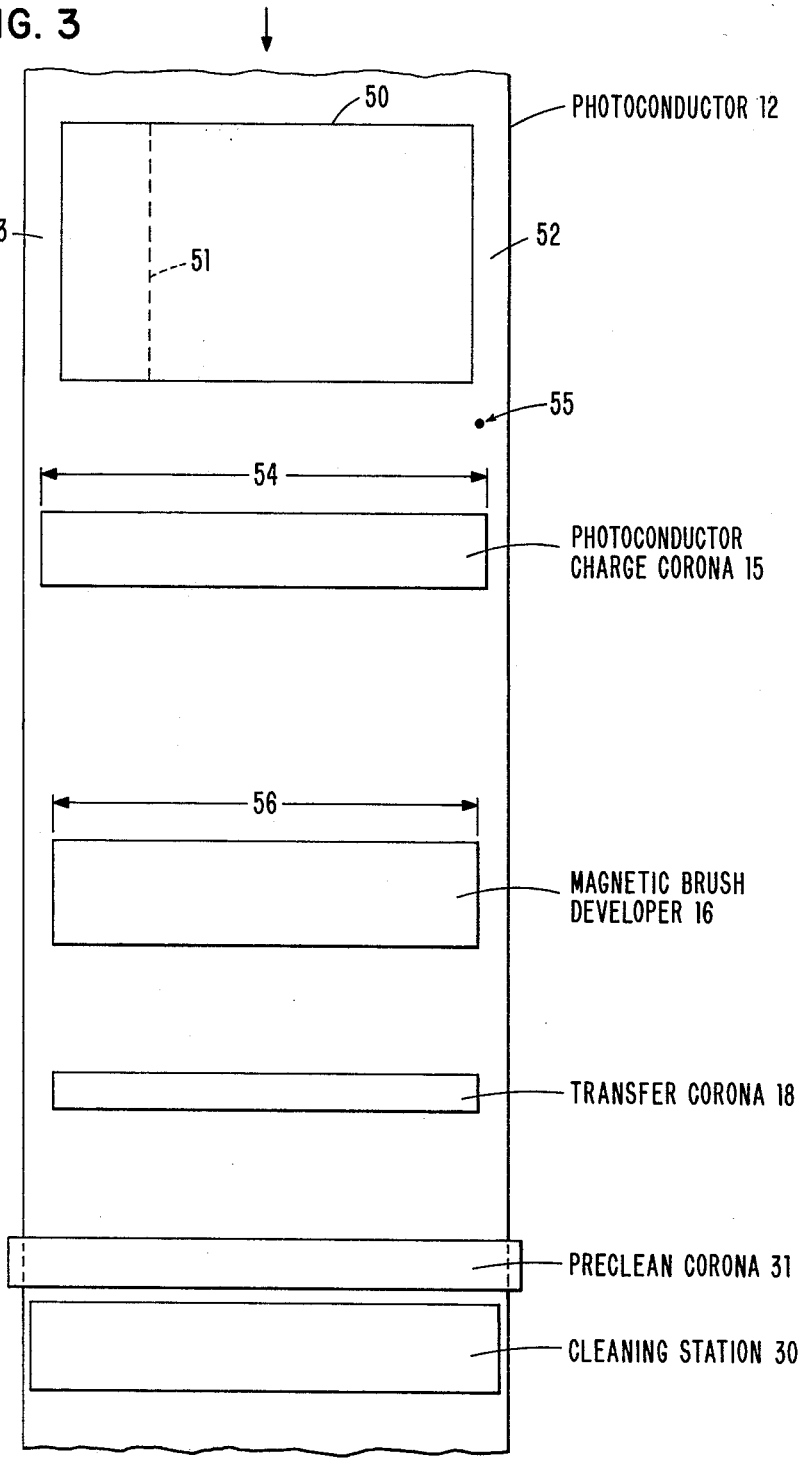
FIG. 3 is a view showing a portion of FIG. 1's photoconductor drum "unrolled", and showing the critical length parameter of the various charging sources and the developer of the present invention.

This is best seen in FIG. 3 wherein a portion of FIG. 1's photoconductor drum is shown unrolled to a flat state, and FIG. 1's photoconductor charging source 15, developing means 16, transfer charging source 18, preclean charging source 31 and cleaning station 30 are spaced as sequentially encountered by a given portion of photoconductor.

For purposes of better defining the photoconductor's working area as that area which will be covered by paper at FIG. 1's transfer station 18, full-line outline 50 shows a legal-size working area, whereas dotted-line 51 and the right-hand portion of outline 50 shows a letter-size working area. The common photoconductor border portion 52 is erased, prior to development, by edge erase lamps, not shown. The variable size photoconductor border portion 53 is erased, in accordance with paper size, and prior to development, by other edge erase lamps, not shown. The portions of the photoconductor upstream and downstream of the working area are erased by interimage erase lamps, not shown.

By way of example, such erased photoconductor areas will carry a voltage of negative 50 volts after such erasure.

In accordance with the above definitions, the photoconductor's width is the horizontal dimension of FIG. 3, and the width of the photoconductor spanned by the various components 15, 16, 18 and 31, in accordance with their length, is also this horizontal dimension. For example, the length of corona 15 is dimension 54.

As is conventional, devices 15, 16, 18, 31 and 30 are centered on the photoconductor.

Relative bead carryout, FIG. 3 shows magnetic brush developer 16, photoconductor charge corona 15 and preclean corona 31 centered on photoconductor 12. It can be generally stated that magnetic brush developer 16 exposes a width of the photoconductor to a magnetic field generally equal to the developer's length dimension 56. The present invention provides a photoconductor charge source 15 whose length 54 is greater than the corresponding dimension 56 of the developer. As a result all portions of the photoconductor corresponding to length 54 will carry a charge of such a polarity as to repel the developer's carrier beads, and will not carry an attaching charge such as is generated by preclean corona 31. This repelling force aids the developer's magnetic field in holding the carrier beads within the developer.

Relative toner filming, charge corona 15 (which must be longer than developer 16 to inhibit bead carryout) and transfer corona 18 must both be shorter than preclean corona 31.

This can be understood by considering an exemplary residual toner particle 55 (greatly enlarged) which remains on the photoconductor after cleaning. This particle is outside of the photoconductor working area and will first be subjected to charging at photoconductor charging source 15, for example negatively. This photoconductor portion is then erased by a light source, not shown. Thereafter, this particle will pass through or adjacent developer 16 and transfer corona 18. However, the length of positive preclean corona 31, which is longer than either of the negative coronas 15 and 18, increases the likelihood that FIG. 1's cleaning station 30 will be able to remove all such residual particles, regardless of their location, due to the cleaning station's affinity for particles having a positive charge. As a result, such residual particles are not subjected to a negative charge without additionally being subjected to a positive charge before entering cleaning station 30.

In summary, and with reference to FIG. 3, bead carryout is reduced by providing charge corona 15 longer than developer 16 to insure that photoconductor portions at the ends of the developer carry a carrier-repelling charge, and yet toner filming is also reduced by providing a charge corona 15 (and a transfer corona 18) shorter than preclean corona 31 to insure that photoconductor portions at the ends of cleaning station 30 carry a charge for which the cleaning station has an affinity.

While the present invention is not to be limited to a magnetic brush developer, a unique cooperation occurs therewith by virtue of the aiding of such a developer's magnetic field in retaining carrier beads within the developer.

While the invention has been particularly shown and described with reference to preferred embodiments thereof, it will be understood by those skilled in the art that various changes in form and details may be made therein without departing from the spirit and scope of the invention.

What is claimed is:

1. In an electrophotographic device wherein a reusable photoconductor is sequentially subjected to a photoconductor charging source of a first polarity, means for discharging a portion of said photoconductor to form an electrostatic latent image of said first polarity, a developing source having carrier beads of said first polarity which transport toner of an opposite polarity to said latent image to tone said image, a transfer station whereat a portion of said toned image is transferred to copy medium, a preclean charging source of said opposite polarity, and a cleaning station operable to remove toner from said photoconductor, the improvement comprising:

a photoconductor charging source spanning a width of said photoconductor greater than the similar width spanned by said developing source, so as to ensure the absence of an opposite polarity carrier-bead-attracting-voltage on the extremities of said photoconductor which is subjected to development, and said photoconductor charging source having a width less than the width of the photoconductor spanned by said preclean charging source, so as to ensure that all toner on said photoconductor has been subjected to said opposite polarity preclean charging source prior to entering said cleaning station.

2. The device defined by claim 1 wherein said cleaning station includes means having an affinity for opposite polarity particles.

3. The device of claim 2 wherein said cleaning station means includes a cleaning brush.

4. The device defined by claim 1 wherein said developing source includes a magnetic brush developer, and wherein said carrier beads are magnetically permeable.

5. The device defined by claim 4 wherein said transfer station includes a transfer charge source of said first polarity which spans a width of said photoconductor less than the width of the photoconductor which is spanned by said preclean charging source.

6. The device defined by claim 1 wherein said transfer station includes a transfer charging source of said first polarity, said preclean charging source spanning a width of said photoconductor which is greater than the similar width spanned by said transfer charging source.

7. In an electrophotographic device wherein a reusable photoconductor is sequentially subjected to a photoconductor charging source of a first polarity, means for discharging a generally-central portion of said photoconductor to form an electrostatic latent image of said first polarity, a developing source having carrier beads of said first polarity which transport toner of an opposite polarity to said latent image to tone said image, a transfer charging source whereat a portion of said toned image is transferred to copy medium, a preclean charging source of said opposite polarity, and a cleaning station having an affinity for particles of said opposite polarity, the improvement comprising:

a charging source construction and arrangement providing a photoconductor charging source which spans a width of said photoconductor greater than the width of said developing source; providing a photoconductor charging source which spans a width of said photoconductor less than the width of said preclean charging source; and providing a preclean charging source which spans a width of said photoconductor greater than said transfer charging source.

* * * * *